US008448615B2

(12) United States Patent
Laufenberg et al.

(10) Patent No.: US 8,448,615 B2
(45) Date of Patent: May 28, 2013

(54) ELECTROMAGNETIC CAMSHAFT-ADJUSTER DEVICE

(75) Inventors: Markus Laufenberg, Radolfzell (DE); Thomas Schiepp, Seitingen-Oberflacht (DE); Simone Nowak, Pluederhausen (DE); Bernd-Heinrich Schmitfranz, Esslingen (DE)

(73) Assignees: Eto Magnetic GmbH, Stockach (DE); Daimler AG, Stuttgart (DE)

( * ) Notice: Subject to any disclaimer, the term of this patent is extended or adjusted under 35 U.S.C. 154(b) by 43 days.

(21) Appl. No.: 13/264,359

(22) PCT Filed: Mar. 31, 2010

(86) PCT No.: PCT/EP2010/002041

§ 371 (c)(1),
(2), (4) Date: Oct. 19, 2011

(87) PCT Pub. No.: WO2010/118826

PCT Pub. Date: Oct. 21, 2010

(65) Prior Publication Data

US 2012/0031360 A1 Feb. 9, 2012

(30) Foreign Application Priority Data

Apr. 16, 2009 (DE) ..... 20 2009 006 940 U

(51) Int. Cl.
*F01L 9/04* (2006.01)

(52) U.S. Cl.
USPC ..... 123/90.11; 123/90.15

(58) Field of Classification Search
USPC ..... 123/90.15, 90.11, 90.16, 90.48
See application file for complete search history.

(56) References Cited

U.S. PATENT DOCUMENTS

2006/0130785 A1* 6/2006 Han et al. ..... 123/90.11
2010/0192885 A1 8/2010 Golz et al.

FOREIGN PATENT DOCUMENTS

DE 102006035225 A1 2/2007
DE 202008008142 U1 10/2008
DE 102008036462 A1 2/2010
EP 1262639 A2 12/2002

* cited by examiner

*Primary Examiner* — Zelalem Eshete
(74) *Attorney, Agent, or Firm* — Bachman & LaPointe, P.C.

(57) ABSTRACT

An electromagnetic camshaft-adjuster device having an armature unit (14, 42) drivable along an axial direction in reaction of a current feed of a stationary inductor unit (10), which for interacting with an adjusting unit (16, 48) causing adjustment of a camshaft of an internal combustion engine is configured with a slide and/or tappet unit, wherein on and/or in the armature unit and/or the adjusting unit, a permanent magnet element (20, 44) is provided and the inductor unit and the armature unit are at least partially received in a housing or supporting unit, and wherein the supporting unit is associated with a configured stationary magnetic field detection element (22, 38) preferably for contactless magnetic interaction with the permanent magnet element, which is configured so that in a current feed condition and a non current feed condition the inductor unit an axial position of the armature unit and/or the adjusting unit can be determined electronically by evaluating a magnetic field detection signal of the magnetic field detection element.

12 Claims, 2 Drawing Sheets

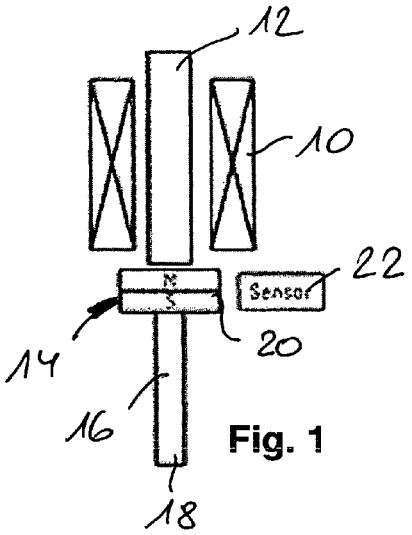
Fig. 1
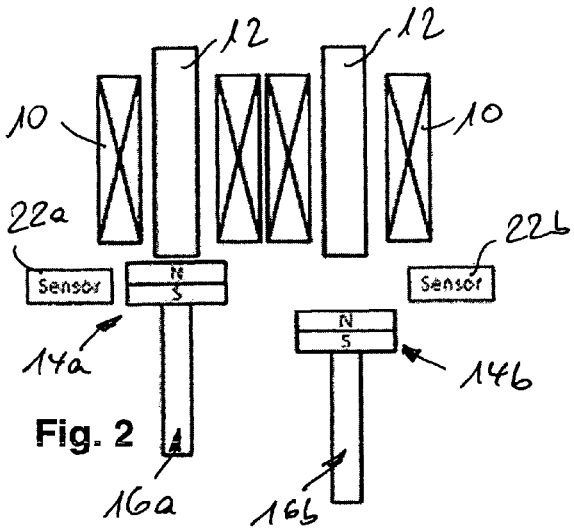
Fig. 2
Fig. 3
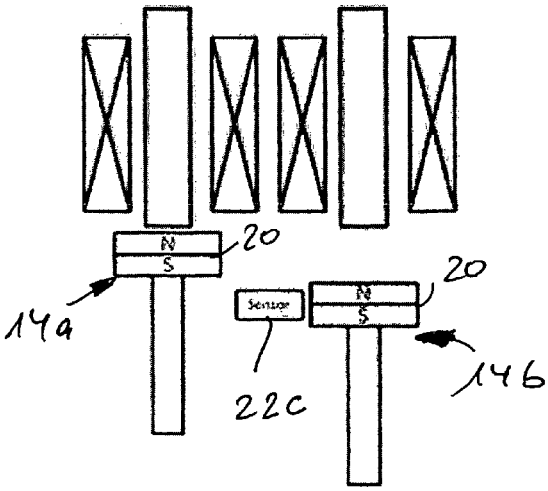
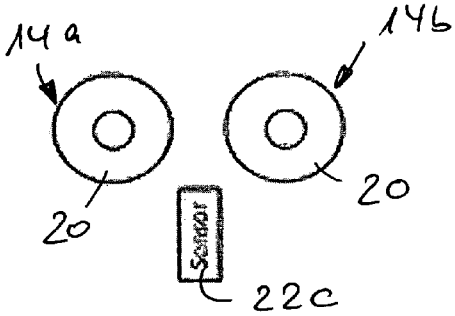
Fig. 4
Fig. 5
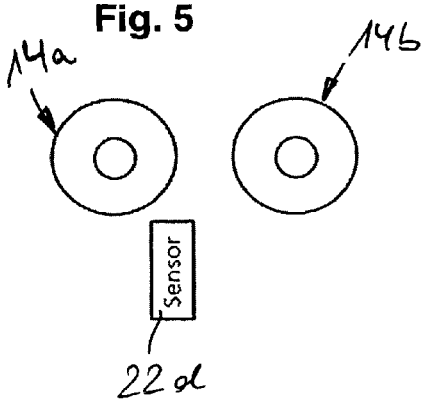

ELECTROMAGNETIC CAMSHAFT-ADJUSTER DEVICE

BACKGROUND OF THE INVENTION

The present invention relates to an electromagnetic camshaft-adjuster device.

Such a device is generally known from the prior art and serves for the so-called reset sensing, wherein for example an induction signal that is sensed and evaluated in the non-energised state of the coil unit of the armature unit moving in accordance with the camshaft position is evaluated at the connecting terminals of the coil unit. Such a device is shown for example by DE 10 2006 035 225 A1 of the applicant.

In addition to this, there are further possibilities of monitoring a correct functioning of a camshaft adjustment, wherein this, however, also takes place indirectly in that for example such a camshaft adjustment monitoring is combined with an anti-knock sensor electronic that is present anyhow, or however a crankshaft acceleration is sensed and evaluated.

All these procedures have in common, however, that any malfunctioning is difficult to determine out of the respective signal and, accordingly, a very complicated (and potentially unreliable) electronic signal evaluation is necessary for determining the concrete tappet position (adjusting unit) for the camshaft. Added to this is that with the induction technology utilised as being generic only a movement of the tappet or of the armature unit can be determined due to the principle, but not its/their stationary state position; in particular, it is not possible with means of the evaluation of an induction coil voltage to reliably sense a (standing) end position of the tappet (adjusting unit) engaging in the camshaft.

As a further potential technical problem it happens that the induction voltage measured in the generic manner is dependent on factors such as movement velocity (this is in turn dependent on the engine rotational speed), the current ambient temperature, contaminations etc., so that thus a desired secure detection of incorrect switching operations is not guaranteed in any operating state.

It is therefore the object of the present invention to create a simple, reliable camshaft-adjuster device that can be realised with a minor effort in terms of manufacturing and evaluation, with which a current camshaft adjusting state or a current position of an armature brining about the camshaft adjustment including the adjusting unit driven by said armature can be reliably determined.

SUMMARY OF THE INVENTION

The object is solved in an advantageous manner according to the invention wherein the housing or supporting unit receiving the camshaft-adjuster device is associated with stationary magnetic field detection means, which interact with permanent magnet means that are moveable corresponding to the armature and/or adjusting unit movement such that in all operating states, namely the energised state of the coil unit and the non-energised state of the coil unit, through this magnetic field detection, an axial position determination is possible. This means that according to the invention a break from the generic principle of the sensing of a coil induction voltage in the de-energised state takes place; the magnetic field detection means are rather advantageously realised as separate sensor means, separated from the coil unit, which in an otherwise known manner and advantageously within the scope of preferred further developments are designed as sensor means realised as Hall sensors, GMR or AMR sensors.

It is particularly preferred, since simple with respect to design, in this case is the realisation according to a preferred embodiment, wherein the armature unit comprises a permanent magnet unit within the framework of the electromagnetic adjusting device itself, which permanent magnet unit advantageously for example through energising of the coil unit carries out a feed movement bringing about the driving of the armature unit (and adjusting unit). This movement of the permanent magnet unit in the armature unit can then be determined by the magnetic field sensor in a very simple manner particularly if said magnetic field sensor is provided adjacent to the permanent magnet unit and because of this (movement-variably) a change of the permanent magnet field can be detected.

In addition or alternatively it is provided within the scope of preferred embodiments of the invention that the tappet unit entirely or partially is designed in a permanent magnetic manner, wherein in this context but also with the configuration of a permanent magnet on the armature unit it is additionally advantageous to releasably configure a connection between adjusting unit (designed as tappet unit) and armature unit through a permanent magnetic adhesion effect between these units.

Within the scope of the invention, the at least one magnetic field sensor for realising the magnetic field detection means is provided on a stationary position in the housing or supporting unit, wherein—significant for production and troublefree operation—it is practical to cast this sensor (if required, together with additional stationary units of the device) in the manner otherwise known by means of a polymer casting material or the like in a manner protected against moisture and dirt. A (relative) position of the magnetic field sensor unit can also be fixed in the housing in this manner, for example in that the casting compound entirely or partially encloses the sensor.

Here, within the scope of the electronic evaluation it is possible and provided on the one hand to perform a binary or digital magnetic field detection through suitable configuration of a (position-dependent) threshold value, while on the other hand it is provided within the scope of preferred embodiments of the invention to suitably and preferably continuously evaluate corresponding different detectable axial or radial parameters of a permanent magnet field, so that for example a complete tracing of the axial travel described by the armature unit (or the adjusting unit) is possible.

Here it is within the scope of preferred exemplary embodiments on the one hand to provide a corresponding plurality of assigned sensor units when using a plurality of driven tappet units (e.g. within the scope of a common housing unit); alternatively it is possible to configure a single, common sensor unit (advantageously for example asymmetrically with regard to the radial arrangement) so that by observing the respective magnetic fields a neat discrimination can take place here and joint sensing with merely one sensor unit is possible.

BRIEF DESCRIPTION OF THE DRAWINGS

Further advantages, features and details are obtained from the following description of preferred exemplary embodiments and by means of the drawings; these show in:

FIG. 1: a schematic view of the construction of the electromagnetic camshaft-adjuster device according to a first embodiment with an armature unit and a tappet unit associated with said armature unit;

FIG. 2: a device similar to FIG. 1 with a pair of armature units provided next to each other and moveable separately from each other each with a seated tappet unit and with an associated sensor unit each;

FIG. 3: a further embodiment similar to FIG. 2, however with a sensor unit jointly provided for both armature units or tappet units;

FIG. 4: a sectional view perpendicularly to the movement longitudinal axis of the arrangement according to FIG. 3 with the shown sensor unit arranged symmetrically with respect to both armature and tappet units;

FIG. 5: a variant of the representation according to FIG. 4 with asymmetrically arranged sensor unit, i.e. different radial distance of the sensor unit from an armature or tappet unit relative to the other armature or tappet unit;

DETAILED DESCRIPTION

Figure 6:
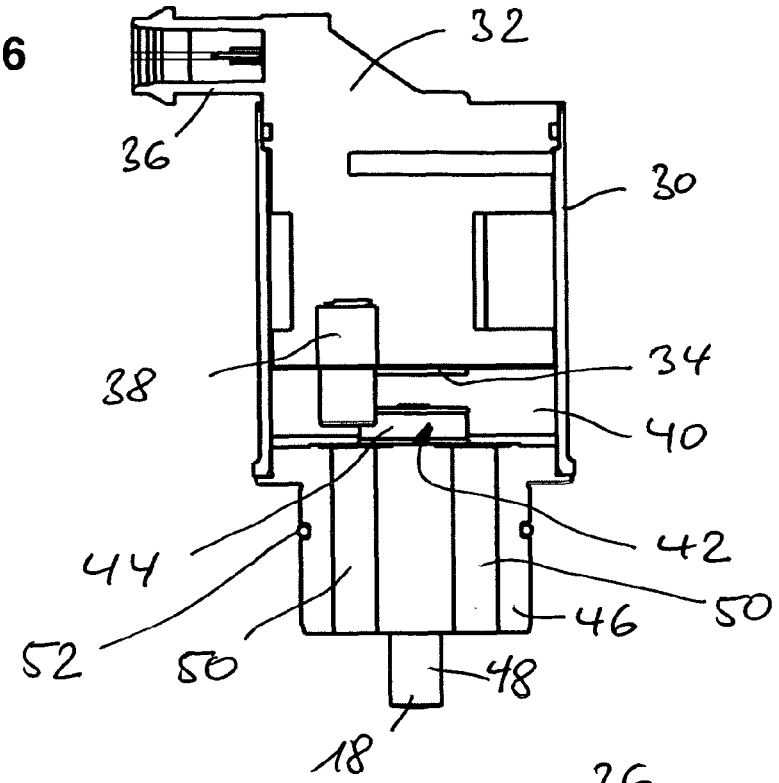
FIG. 6: a longitudinal section through a concrete realisation form of the electromagnetic camshaft-adjuster device for realising the schematic of FIG. 1.

FIG. 1 illustrates the construction and the operating principle of the electromagnetic camshaft-adjuster device according to a first embodiment of the invention: in a housing unit (not shown) a stationary coil unit 10 is provided, which is formed about a stationary core 12. In these stationary units, an armature unit 14 with seated tappet unit 16 is moveably mounted in axial direction (i.e. longitudinal direction in FIG. 1), which with its engagement-sided end 18 in the manner otherwise known is designed for interacting with a groove or the like of a camshaft adjustment.

The armature unit 14 comprises a permanent magnet unit 20, which axially magnetised in the shown manner and is positioned opposite the core manner such that as reaction to an energising of the coil unit 10 the armature unit including seated tappet unit 16 (this is held on the permanent magnet unit either in a fixed manner or releasably through adhesive force of the permanent magnet unit 20) is moved in axial direction (i.e. downwards in the FIG. 1).

For realising the invention, the permanent magnet unit 20 is associated with a stationary sensor unit 22 (suitably provided in the housing which is not shown in the Figures), which detects the permanent magnetic field and, suitably realised as Hall element, can sense this magnetic field and its change through movement of the armature unit 14 and feed it to a following electronic evaluation.

Advantageously, this fundamental realisation form makes it possible, along a suitable movement stroke of the armature unit 14 to generate a corresponding position-variable signal which—advantageously relative for example the known principle of a sensing of an induction voltage at the coil ends of the unit 10 in the non-energised state—at any energisation point of time of the coil unit 10 can carry out a position sensing and sense the position even when the armature unit is not moving, in other words is stationary in a corresponding position.

Figure 7:
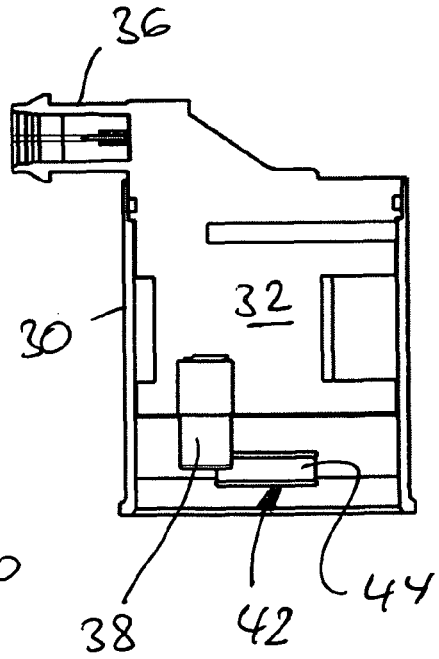
FIG. 7: a longitudinal section through the upper housing section of the exemplary embodiment of FIG. 6 and FIG. 8: a perspective representation of a detail from FIG. 7 for illustrating the three-dimensionality.

The representation of FIG. 1 (as otherwise also of the FIGS. 2 to 5) merely shows the schematic interaction for realising the basic principle of the invention; the concrete realisation of an exemplary embodiment is explained in connection with the FIGS. 6 to 8, while reference with respect to a favourable realisation of the actuation system shown in the FIGS. 1 to 5 is made to the disclosed Patent Application DE 20 2008 010 301 of the applicant which with respect to the configuration of a surrounding housing, the core, yoke and armature unit as well as the coil unit is to be considered incorporated in the present application as belonging to the invention.

A particularly favourable further development is shown by the exemplary embodiment of FIG. 2, wherein (here, in a common housing which is not shown) a pair of actuators each consisting of coil unit 10, core unit 12 and armature units 14*a* and 14*b* respectively is provided next to each other; especially in connection with a camshaft adjustment, devices with two tappets are frequently employed, wherein a first tappet 16*a* is used in order to move the camshaft-adjuster mechanism into a first position and a second tappet 16*b* driven axially in parallel is used in order to bring about the resetting into the starting position. Because of the frequently restrictive installation space requirements, the arrangement exemplarily and schematically shown in FIG. 2 is accommodated in a common housing.

The exemplary embodiment of FIG. 2 additionally shows two sensors 22*a* and 22*b*, which, similar to the representation of FIG. 1 (in this regard, corresponding reference characters are also used), are associated with a respective armature unit or tappet unit.

FIG. 3 shows a variant of the realisation form of FIG. 2 (and corresponding reference characters are again used with comparable assemblies). Deviating from the realisation of FIG. 2 each with an associated sensor unit 22*a* and 22*b*, the device of FIG. 3 shows a common sensor unit 22*c*, which, compare the radial sectional representation of FIG. 4 sectioned at the height of the sensor, is arranged approximately symmetrically between both armature units (respectively of the respective permanent magnet 20) in such a manner that a radial spacing to both permanent magnet arrangements 20 influencing the measured field strength is the same in the section plane and with the same axial position of the armature units 14*a*, 14*b* generates a magnetic field each which is the same in the absolute amount but a magnetic field that is divergent in the respective direction.

Through suitable evaluation, particularly of the magnetic field directions, the reliable evaluation of a pair of armature and tappet movements, for example as shown in FIG. 2, is possible even with a common (single) sensor unit 22*c*. A further alternative, for example for the improved distinction of the respective detected permanent magnetic fields would then, according to the arrangement of FIG. 5 (with otherwise identical realisation) be the arrangement of a common (single) sensor device 22*d* slightly offset from the middle symmetry would have to be provided, which stands closer to the armature unit 14*a* and insofar receives a stronger permanent magnetic signal here.

In connection with the FIGS. 6 to 8 a practical-design realisation of the exemplary embodiment of FIG. 1 is described in the following. Surrounded by a cylindrical housing shell 30 and over-moulded by a plastic casting material 32 a coil unit including core unit (detectable is merely a planar end region 34, which protrudes from the over moulding) is provided; in a manner which is not shown in more detail the coil unit is electrically contacted and the connecting cable for the external contacting routed to a unitarily seated connector section 36.

It is shown, furthermore, how a cylindrical sensor unit 38 is fastened in the housing so that approximately half of it is enclosed by casting material 32 and with its (in the FIG. 6, lower) half protrudes into a hollow space 40 in the housing 30. Into this hollow space, axially moveable relative to the core 34 there protrudes from the opposite side an armature unit 42, which in the middle carries a disc-shaped permanent magnet 44, which in the manner described before interacts in a contactless manner with the sensor unit 38 so that upon axial (i.e. in FIG. 6, vertical) movement of the armature unit the stationary sensor unit 38 detects a changing permanent magnetic field and feeds this (in a manner which is not shown in more detail) to a following electronic processing.

The housing 30 is closed at the bottom with an end piece 46, in which a tappet unit 48 is guided; on the one end (on the upper end) this contacts the armature unit 42 or is part of it, while in the opposite end region the camshaft-adjuster engagement region 18 is formed. Channels 50 in the bottom piece 46 serve for the ventilation and a circumferential radial seal 52 for the sealing with respect to a receiving housing of the adjusting partner, e.g. the camshaft housing.

Figure 8:
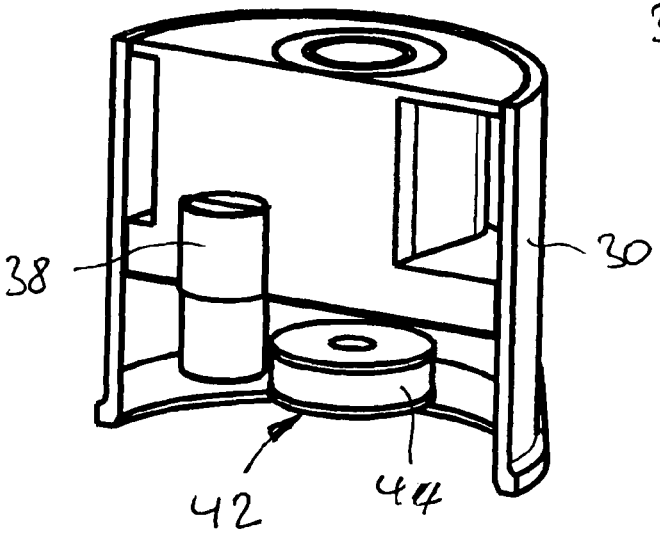

FIG. 8 once more favourably illustrates in this connection how the casting compound 32 is provided in the housing shell 30 and reliably holds the sensor unit 38 protected from dirt and easy to install in its relative position to the permanent magnet 44 or to the armature unit 42.

The present invention is not restricted to the described exemplary embodiments. Although it is favourable for the sensor unit to employ a conventional permanent magnet detector principle (Hall, GMR or AMR), other magnetic detection possibilities are also conceivable however.

The present invention is also favourable as camshaft-adjuster device, however the principle of an electromagnetic actuator device, particularly in connection with a permanent magnet on the armature and a stationary magnetic field detection of this armature is suitable for fundamentally any adjusting tasks which in the manner described advantageously and for any operating situations require a reliable detection of the armature or tappet position.

The invention claimed is:

1. An electromagnetic camshaft-adjuster device comprising:

a stationary coil unit (10), formed about a stationary core (12);

an armature unit (14) having a tappet unit (16) movable in a longitudinal direction upon energisation of the stationary coil unit, the tappet unit has an engagement end (18) for camshaft adjustment and a permanent magnet unit end (20) opposed to the engagement end (18);

the supporting unit is associated with a stationary magnetic field detection means (22; 38) designed for the contactless magnetic interaction with the permanent magnet unit and designed so that, in an energisation and non-energisation state of the stationary coil unit through evaluation of a magnetic field detection signal generated by the magnetic field detection means, an axial position of the armature unit and/or of the adjusting unit can be electronically determined.

2. The device according to claim 1, wherein the permanent magnet unit through the energisation drives the armature unit through magnetic repulsion effect.

3. The device according to claim 1, wherein the tappet unit (16) is releasably held on the armature unit by a permanent-magnetic adhesion force of the permanent magnet unit.

4. The device according to claim 1, wherein the magnetic field detection means (38) comprises a magnetic field sensor provided adjacent to the armature unit.

5. The device according to claim 4, wherein the magnetic field sensor is at least partially enclosed by a polymer moulding provided in a housing at least partially enclosing the stationary coil unit and the armature unit.

6. The device according to claim 4, wherein the magnetic field detection means comprises a magnetic field sensor designed as one of a Hall sensor, a GMR sensor, or an AMR sensor.

7. The device according to claim 1, wherein the magnetic field detection means generates a binary and/or digital magnetic field detection signal corresponding to the position of the armature unit or of the adjusting unit.

8. The device according to claim 1, wherein the magnetic field detection means outputs an electronic magnetic field detection signal, which corresponds to a detected field strength of the permanent magnet unit, of a polarity change of the magnetic field of the permanent magnet unit in radial direction, of a polarity change of the magnetic field of the permanent magnet unit in axial direction and/or a magnetic field directional change of the magnetic field of the permanent magnet unit.

9. The device according to claim 5, wherein in the housing are provided a plurality of armature and/or adjusting units (14*a*, 14*b*) which are driveable independently of one another.

10. The device according to claim 9, wherein the plurality of the armature and/or adjusting units in a common magnetic field sensing region of the permanent magnetic unit is associated with a single sensor unit (22*c*; 22*d*) as magnetic field detection means.

11. The device according to claim 10, wherein the individual magnetic field sensor (22*d*) is stationarily provided in a radial plane perpendicular to the axial direction in a non-symmetrical relative position between at least two armature units and/or adjusting units.

12. The device according to claim 9, wherein the plurality of the armature units or adjusting units are associated with a corresponding plurality of magnetic field sensors (22*a*, 22*b*) as magnetic field detection means in the housing.

* * * * *